United States Patent [19]

Disbrow et al.

[11] 4,305,578

[45] Dec. 15, 1981

[54] EXERCISE EQUIPMENT

[75] Inventors: Richard A. Disbrow, Battle Creek; Russel O. Blanchard, Marshall, both of Mich.

[73] Assignee: Fitness Products, Inc., Battle Creek, Mich.

[21] Appl. No.: 147,028

[22] Filed: May 6, 1980

[51] Int. Cl.[3] ..... A63B 69/16; F16B 7/10

[52] U.S. Cl. ..... 272/73; 188/24.11; 272/DIG. 3; 272/DIG. 4; 248/297.3; 403/108; 403/379

[58] Field of Search ..... 272/73, 70.1, 70.2, 272/DIG. 4, DIG. 3; 128/25 R; 248/161, 407, 412, 297.3, 354 P; 403/108, 109, 378, 379; D21/71, 76, 194; 188/24.11

[56] References Cited

U.S. PATENT DOCUMENTS

| | | | |
|---|---|---|---|
| Re. 25,225 | 8/1962 | Moritz et al. | 248/354 P |
| 2,180,617 | 11/1939 | Snell . | |
| 2,510,973 | 6/1950 | Guillemin, Jr. . | |
| 2,604,925 | 7/1952 | Swift . | |
| 3,192,727 | 7/1965 | Tarter . | |
| 3,259,385 | 7/1966 | Boren | 272/73 |
| 3,360,263 | 12/1967 | Tsuru | 272/73 |
| 3,758,107 | 9/1973 | Potgieter . | |
| 3,960,406 | 6/1976 | Buker . | |
| 4,079,931 | 3/1978 | Valentine et al. | 272/73 |
| 4,084,810 | 4/1978 | Forsman | 272/73 |
| 4,148,478 | 4/1979 | Moyski et al. | 272/73 |
| 4,243,217 | 1/1981 | Gibbs | 272/73 |

FOREIGN PATENT DOCUMENTS

| | | | |
|---|---|---|---|
| 370958 | 1/1907 | France | 248/407 |
| 548570 | 10/1922 | France | 248/161 |
| 1359920 | 3/1964 | France | 248/354 P |
| 2432321 | 2/1980 | France | 272/73 |
| 4128 | of 1898 | United Kingdom | 272/73 |
| 432220 | 7/1935 | United Kingdom | 272/73 |
| 936469 | 9/1963 | United Kingdom | 272/73 |

*Primary Examiner*—Richard J. Apley
*Assistant Examiner*—Arnold W. Kramer
*Attorney, Agent, or Firm*—Krass, Young & Schivley

[57] ABSTRACT

An exercycle (10) having a generally continuous U-shaped frame (12) with two upwardly extending posts (14, 16) bridged by a substantially linear connecting portion (18) positioned closely to and paralleling the floor. A seat (24) is attached to the end of one of the posts (16) and handlebars (20) are secured to the end of the other post (14). Pedals (84, 86) are affixed to the seat post (16) between the seat (24) and the connecting portions (18) of the frame (12). A wheel (88) is disposed rearwardly of the seat post (16). A drive mechanism (91, 92) coupled between the pedals (84, 86) and the wheel (88) serves to impart rotational movement to the wheel (88) when the pedals (84, 86) are moved by the user. The exercycle construction provides an unobstructed passageway between the handlebars (20) and the seat (24) to facilitate easy mounting and dismounting of the apparatus by the user. The handlebars (20) and seat (24) are provided with unique adjustment assemblies that can be used without needing tools. Structure (64) is also disclosed for adjusting the pedalling tension.

15 Claims, 5 Drawing Figures

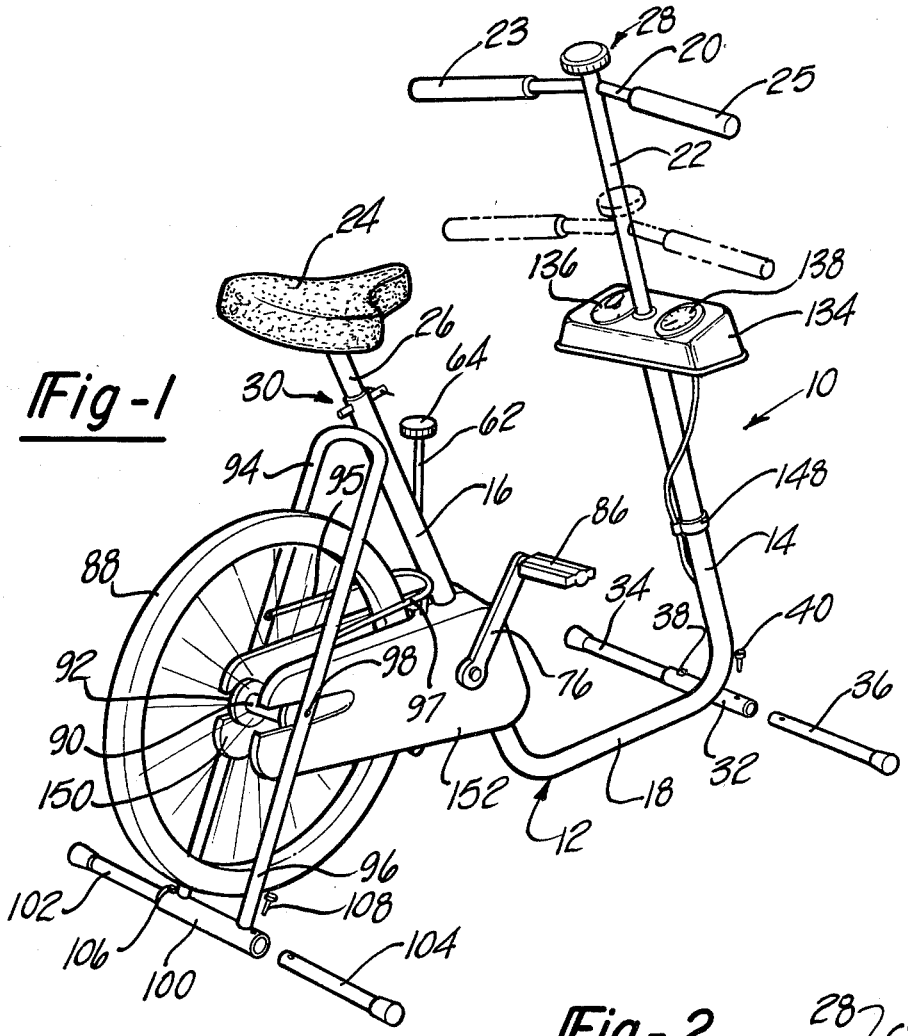
Fig-1
Fig-2
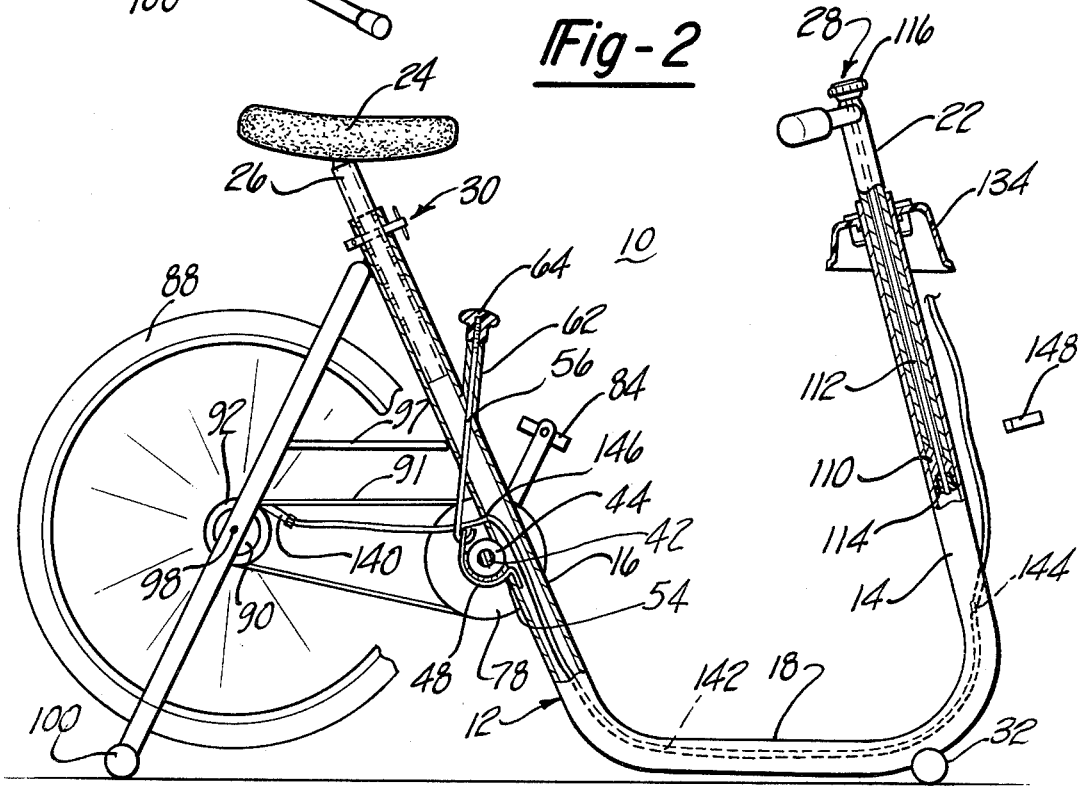

EXERCISE EQUIPMENT

DESCRIPTION

1. Technical Field

This invention relates generally to exercising apparatus, and more particularly to equipment which simulates bicycle riding, often referred to as an exercycle.

2. Background Art

Exercycles have been one of the most popular pieces of exercise equipment found in gymnasiums and health spas for many years. In recent years, such equipment has enjoyed increasing popularity in the area of physical therapy. It has been discovered that the movement of the limbs during use of exercycles provides excellent therapy for the aged and handicapped. Exercycles closely resemble bicycles in that they include a seat, a pair of pedals, and a handlebar arrangement generally corresponding to that found in a bicycle. Often, the equipment will have a front driven wheel which is braked by a drag or adjustable tension control assembly. U.S. Pat. No. 4,079,931 to Valentine et al is representative of the types of exercycles known in the marketplace. U.S. Pat. No. 4,148,478 to Moyski discloses a similar exercycle except that the tension is adjusted by way of a brake pad on the pedal crankshaft instead of the front wheel.

Various design alternatives have in the past been explored by the prior art. For example, U.S. Pat. No. 2,510,973 to Guillemin, Jr.; U.S. Pat. No. 3,192,772 to Tartar, and U.S. Pat. No. 3,758,107 to Potgieter disclose exercycles having rearwardly mounted wheels. However, these designs as well as the front wheel driven structures, are relatively difficult for the handicapped to mount. The crossbar portion which bridges the handlebar post and the seat post of the exercycle frame is at least 15" from the floor in the prior art structures. Accordingly, great difficulty is encountered by many handicapped patients in stepping over this obstruction in order to mount the seat. In some cases, the patient must be physically lifted over the crossbar frame. While this obtrusive crossbar does not present a significant problem for a healthy person to originally mount the exercycle, it does increase the chances of the user tripping over it after his legs are fatigued by vigorous exercise on the equipment.

It is also extremely important to permit a wide variety of different seat and handlebar positions to accommodate a variety of riding positions, be it of necessity for a handicapped person or merely a preference for a healthy person. In any event, the prior art suffered from the problem that such adjustments could not be readily made and required the use of hand tools. It is highly desirable to be able to make such adjustments not only without the necessity of tools but also relatively simply and quickly. Numerous handlebar structures have been used in the past. U.S. Pat. No. 2,180,617 to Snell and U.S. Pat. No. 2,505,648 to Pawsat disclose height adjustment features for the handlebars. However, it can be seen that such adjustment could not be made easily by the rider while mounted on the seat by way of these assemblies and, further, required hand tools to make the adjustment.

An equally large number of different seat adjustment assembly designs have been disclosed, the most common being a simple clamping mechanism for securing the seat mast within a tubular post. Recognizing that this clamp assembly requires hand tools, the art has progressed to designs utilizing removable pins which pass through a desired pair of holes in the seat mast spaced at different locations. In French Pat. No. 370,958 the seat post includes two diametrically opposed inboard openings through which the pin passes to lock the seat in place. However, this technique is somewhat cumbersome in that the user must dismount the bike and move the seat mast up and down until the holes therein align with the openings in the post so that the pin can pass through both sets of openings. Since the holes in the seat mast are obstructed from view by the post, some difficulty is encountered in properly aligning the openings. In U.S. Pat. No. 2,604,925 to Swift and U.S. Pat. No. 3,960,406 to Buker, the post includes two aligned notches or grooves for receiving the ends of the pin which has been placed through the desired seat mast holes. While this approach obviates the problem of aligning the two sets of openings, the seat is not locked in place along the vertical axis. If these seat adjustment assemblies were used in an exercycle, the seat may have a tendency to come off of the post or at least wobble therein by gyratory motions of the user when operating the equipment.

The present invention is directed to overcoming one or more of the problems as set forth above.

DISCLOSURE OF THE INVENTION

According to one aspect of the present invention, the exercycle is provided with a "step through" frame consisting of a generally continuous U-shaped frame member having two upwardly extending posts bridged by a substantially linear connecting portion positioned closely and generally paralleling the floor. The seat is attached to one end of the post and the handlebars are secured to the end of the other post. The pedals are affixed to the seat post between the seat and the connecting portion of the frame. Accordingly, the frame design provides an unobstructed passageway between the handlebars and the seat to facilitate easy mounting and dismounting of the exercycle. Thus, in contrast with the prior art where the user had to step over the crossbar portion which ordinarily is at least 15" above the ground, the present invention eliminates the problems that the handicapped and the weary user may encounter in getting on and off the equipment. Preferably, a wheel is disposed rearwardly of the seat post. Drive means coupled between the pedals and the wheel serve to impart rotational movement to the wheel when the pedals are activated by the user. Since the drive means and wheel are rearwardly disposed with respect to the seat post, the space between the seat post and the handlebar post remains unobstructed.

Another feature of this invention includes an adjustable seat assembly having a plurality of pairs of aligned holes along the longitudinal length of the seat mast. The end of the seat post includes an inboard opening and a diametrically opposed groove therein. The seat may be easily adjusted in height and appropriately aligned with respect to the handlebars by placing a pin through the desired mast holes, nesting the pin in the post groove and inserting the pin through the inboard opening in the post which is automatically aligned with the pin when nested in the groove. No tools are needed to make this adjustment and the seat is locked in place against both rotational and vertical movement.

Like the seat, the handlebars can be adjusted in height without the use of any hand tools. Pursuant to another aspect of this invention, a handlebar adjustment assembly includes a shaft inserted into the tubular handlebar post of the frame. A wedge is disposed beneath the shaft and a threaded link couples the wedge to a knob rotatable by the user without additional tools. Rotation of the knob urges the wedge between the shaft and the post when tightened to secure the handlebar assembly at the desired height. This can be accomplished while the user is riding the exercycle.

A unique adjustable tension control assembly is also provided for frictionally engaging the pedal crankshaft with a brake pad. The assembly includes a pivot plate having a central portion carrying the brake pad which generally conforms to the crankshaft. The plate includes a lip at one end pivotally engaged with an opening in the seat post of the frame. Manually operable means coupled to the other end of the plate is provided for pivoting the plate about the lip to control the amount of frictional engagement of the pad against the crankshaft. Preferably, the adjustment means is attained by way of a threaded shaft projecting through the seat post into the crankshaft housing, operative to raise and lower the pivot plate in response to rotational movement of the shaft imparted to it by way of a knob readily accessible by the user while riding the exercycle.

BRIEF DESCRIPTION OF THE DRAWINGS

Other objects and advantages of this invention will become apparent upon reading the foregoing specification and by reference to the drawings in which:

FIG. 1 is a prespective view of the preferred embodiment of this invention;

FIG. 2 is a side view thereof with parts in cross section;

BEST MODE FOR CARRYING OUT THE INVENTION

Figures 3, 4, 5:
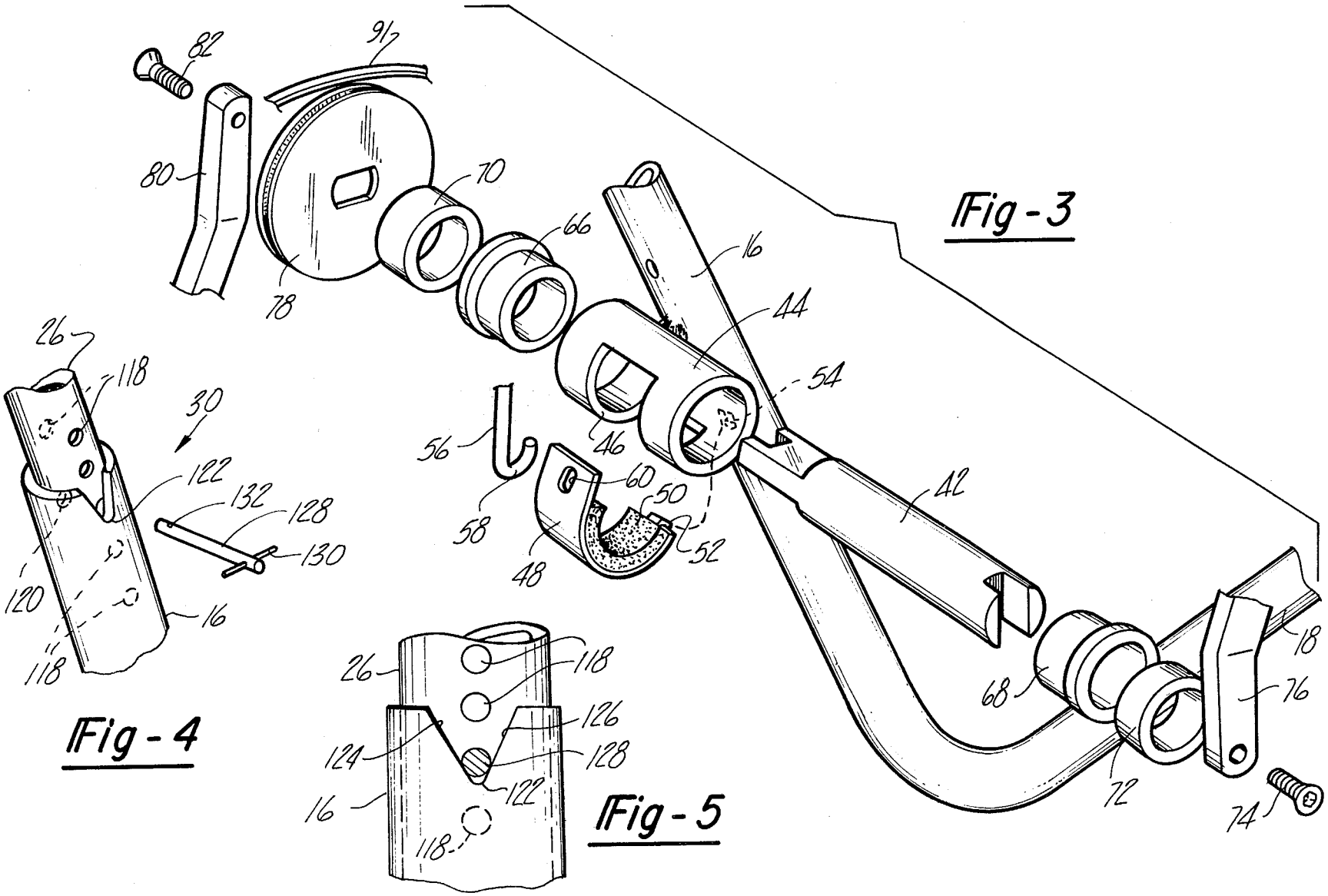
FIG. 3 is an exploded perspective view of the tension control assembly.
FIG. 4 is a perspective view of the seat adjustment assembly.
FIG. 5 is a side elevational view of FIG. 4.

Referring now to the drawings, the exercycle 10 according to the broadest aspect of this invention incorporates a U-shaped "step through" frame 12. Frame 12 includes two generally vertically extending posts 14 and 16 bridged by a substantially linear connecting portion 18 positioned closely to and generally paralleling the floor. Frame 12 is preferably made of relatively light weight tubular steel. A handlebar assembly 20 utilizes a shaft 22 which telescopes into the end of post 14 and a pair of neoprene foam grips 23, 25. Similarly, seat 24 is secured to the end of post 16 through mast 26. Handlebars 20 and seat 24 are adjustable in height by way of adjustment assemblies 28 and 30, respectively, which will be described in detail later herein.

A front stabilizer bar 32 is transversely welded to the elbow between the handlebar post 14 and connecting portion 18 of frame 12. Extension tubes 34 and 36 are inserted into bar 32 and secured by way of screws 38 and 40, respectively.

A pedalling arrangement is affixed to post 16 between the seat 24 and the connecting portion 18 of frame 12. As can be seen most clearly in FIGS. 2 and 3, the pedalling arrangement includes a crankshaft 42 journaled in a housing 44 welded to frame 16. Housing 44 includes a cut-away portion 46 for receiving a pivot plate 48 which carries a brake pad liner 50. Pivot plate 48 has a lip 52 for engaging an opening 54 in post 16 beneath the point of attachment with housing 44. The central portion of pivot plate 48 and brake pad 50 generally conforms with the circular shape of crankshaft 42. Preferably, brake pad 50 is made of an impregnated asbestos material. A link 56 includes a hooked end portion 58 for engaging a corresponding opening 60 in the opposite end of pivot plate 48. Link 56 is a generally rigid rod which passes vertically through seat post 16 and into a tube 62 for the tension control assembly. The opposite end of link 56 is threaded and coupled to a tapped opening in a knob 64. (See FIG. 2) Rotational movement of knob 64 causes vertical movement of link 56 which, in turn, pivots plate 48 about lip 52. Accordingly, the user can readily vary the frictional resistance of brake pad 50 against the crankshaft 42 to thereby adjust the resistance of the pedalling assembly to leg movement of the user. The tension control feature of this invention is very accessible to the user, is relatively easy to assemble, and is quite reliable since there are few moving parts.

As shown in FIG. 3, the pedalling assembly is completed by way of left and right bushings 66, 68 and spacers 70, 72, respectively. A bolt 74 secures the right hand pedal crank 76 to one end of crankshaft 42. A drive wheel 78 and left pedal crank 80 are secured to the flattened left hand portion of crankshaft 42 by way of bolt 82. Left and right pedals 84, 86 finish the assembly.

With reference particularly to FIGS. 1 and 2, a rearwardly disposed wheel 88 is mounted for rotational movement by way of a drive mechanism coupled to the pedalling assembly. The drive mechanism conventionally includes an axle 90 having a drive wheel 92 mounted on one end thereof. A flexible V-belt 91 rides in notches in drive wheels 92 and 78 to thus impart rotational movement to wheel 88 when the user reciprocates pedals 84, 86.

Wheel 88 is spaced from the floor by way of supporting legs 94, 96 whose mediate portions are coupled to axle 90 by bolt 98. Upper ends of legs 94, 96 are welded to frame post 16 beneath seat 24. The lower ends of legs 94, 96 are secured to a transversely mounted rear stablizer bar 100 which includes extensions 102, 104 secured by screws 106, 108. Horizontally extending struts 95, 97 add further support.

The shaft 22 of handlebar assembly 28 telescopes into post 14 to provide a wide variety of height positions as noted by the phantom lines in FIG. 1. The end of shaft 22 is diagonally cut. A hollow wedge 110 having a conforming diagonal cut is disposed beneath shaft 22. An elongated rod 112 is threaded at its lower end onto a flanged nut 114. The opposite end of rod 112 projects above the end of post 14 and is secured to knob 116 disposed at the fork between the two handlebar portions. Rotation of knob 116 in one direction loosens the nut 114 such that the handlebar shaft 22 can be positioned at an infinite number of heights while the rider is mounted on seat 24. Once the handlebar is in the desired position, rotation of knob 116 in the opposite direction will urge the wedge 110 between the outer surfaces of shaft 22 and the inner surfaces of post 14 to thereby lock the handlebar assembly in place.

Turning now especially to FIGS. 4 and 5, the seat adjustment assembly includes a plurality of pairs of aligned holes 118 in seat mast 26 spaced along its longitudinal axis. The end of seat post 16 includes an inboard opening 120 that is spaced from the end of post 16. A V-shaped groove 122 is disposed diametrically opposite from opening 120 in the end of post 16. The periphery of opening 120 is chosen so that it is tangential with the inclined surfaces 124, 126 of groove 122 as can be seen most clearly in FIG. 5. In the preferred embodiment, opening 120 is about 0.26 inches in diameter and is spaced about one half of an inch from the end of post 16. Groove 122 subtends an angle of about 60° and has a radius of about 0.06 inches at its apex. A removable pin 128 has a diameter slightly less than opening 120 and in this embodiment is about 0.25 inches in diameter. Pin 128 preferably includes a cross bar portion 130 for preventing the pin from passing through mast openings 118. In use, the user places pin 128 through at least the forward one of the desired mast hole pairs 118. A spring loaded ball 132 is advantageously provided so that the user can place pin 128 partially through the rearward mast hole 118 to a limited degree without protruding from the rearward portion of seat mast 26. The ball 132 is spaced a distance, less than the thickness of the mast walls, from the end of pin 128 to thereby act as an initial stop that the user can feel when he inserts the pin 128 partially through the second hole of the selected pair. The user then nests the pin 128 in the groove 122. In doing so, the rearward mast hole 118 is automatically aligned with the opening 120 in seat post 16. Thus, all that the user need do is to complete the insertion of the pin 128 into the opening 120 to lock the seat in place. It is important to note that the seat not only can be easily adjusted as just explained, but that the seat is locked in place and properly aligned with respect to the handlebars 20. The inboard opening 120 prevents vertical movement of the seat 24, while the pin 128 wedged in the groove 122 prevents rotational movement of the seat 24.

The exercycle according to the preferred embodiment of this invention may include a console 134 which includes a timer 136 and a speedometer display 138 mounted on handlebar post 14. As can be seen more particularly in FIG. 2, the speedometer display is coupled to a sensor 140 on the rear wheel 88 by way of a cable 142. Sensor 140 may be of conventional design which detects the speed of the rotational movement of wheel 88. Cable 142 is threaded through the inner confines of frame 12 via handlebar post opening 144 and seat post opening 146. Accordingly, the space between the handlebar post 14 and the seat post 116 remains unobstructed. A tie 148 clamps the cable 142 to post 14 where the cable 142 cannot pass through its inner confines because of the handlebar assembly 28. Belt guard covers 150, 152 shields the user from the drive mechanism for the rear wheel 88.

In view of the foregoing it can now be realized that the present invention provides a unique exercycle which can be readily mounted and adjusted to various positions by the user. As can be seen clearly in FIGS. 1 and 2, the connecting portion 18 of frame 12 is substantially co-planar with the forward and rear stabilizer bars 32 and 100. In contrast with the prior art designs having cross bar portions extending almost 15" from the floor, connecting portion 18 is only about 1½" from the floor. Consequently, handicapped persons will not encounter any difficulty in stepping through the frame in order to mount the equipment. Additionally, the unique "step through" frame substantially eliminates the possibility of a fatigued user tripping over it. The handlebar adjustment feature provides the capability of easily adjusting the height of the handlebars even while riding the exercycle. No tools are needed, instead, the user need only rotate a readily accessible knob to adjust the position of the handlebars. Similarly, the seat adjustment assembly needs no tools. Adjustment of the seat can be accomplished almost blindly since the holes in the seat mast and the frame are automatically aligned. Further, as noted above, the seat remains locked in place and will not have a tendency to wobble while vigorously exercising on the equipment.

Therefore, while this invention has been described in connection with particular examples thereof, no limitation is intended thereby except as defined in the appended claims.

We claim:

1. An exercycle (10) comprising:

a seat (24);

a pair of handlebars (20);

pedals (84, 86);

a U-shaped frame member (12) having two upwardly extending posts (14, 16) which are slanted in a given direction and bridged by a substantially linear connecting portion (18) positioned closely to and generally paralleling the floor, said seat (24) being attached to the end of one of said posts (16) and the handlebars (20) being secured to the end of the other post (14), with said pedals (84, 86) being affixed to the seat post (16) between said seat (24) and the connecting portion (18) of the frame (12);

a front stabilizer bar (32) transversely secured to the connecting portion (18) of the frame (12) substantially beneath the handlebar post (14);

a rear stabilizer bar (100) spaced from and extending transversely to the frame (12);

at least one leg (94) slanted in an opposite direction connected between the rear stabilizer bar (100) and the seat post (16) beneath the seat (14);

a wheel (88) disposed rearwardly of the seat post (16) and supported above the floor on said leg (94);

drive means (91, 92) coupled between the pedals (84, 86) and the wheel (88), adapted to impart rotational movement to the wheel when the pedals (84, 86) are moved by the user;

said connecting portion (18) of the frame (12) being substantially co-planar with the front (32) and rear (100) stabilizer bars whereby said frame (12) and drive means (91, 92) cooperate to provide an unobstructed passageway between the handlebars (20) and the seat (24) to facilitate easy mounting and dismounting of the exercycle (10) by the user; and an adjustable seat assembly having a seat mast (26) with a plurality of pairs (118) of diametrically opposed aligned holes along the longitudinal length thereof, said end of the seat post (16) being hollow and having an inboard opening (120) in the form of a hole and a groove (122) opening through the end of said post diametrically opposing said hole opening (120), and a pin (128) for insertion into the mast holes (118) and post hole opening (120) while nesting in the groove (122);

whereby the seat (24) may be easily adjusted in height by placing the pin (128) through the desired mast holes (118), nesting the pin (128) in the post groove (122), and inserting the pin (128) through the imboard hole opening (120) in the post (16) which is automatically aligned with the pin (128) when nested in the groove (122) to thereby lock the seat (24) in place.

2. The exercycle of claim 1 wherein said groove (122) is V-shaped and the periphery of the inboard hole opening (120) is tangential to the inclined surfaces (124, 126)

of the groove (120) such that the pin (128) is wedged in the groove (122) to prevent rotational movement of the seat (24).

3. The exercycle of claim 1 which further comprises means (28) for manually adjusting the height of said handlebars (20) without the necessity of using hand tools whereby the user can adjust the height thereof while riding the exercycle (10).

4. The exercycle of claim 3 wherein said handlebar adjustment means includes a shaft (22) inserted into the handlebar post (14) of the frame (12), a wedge (110) disposed beneath the shaft (22), a threaded rod (112) coupled to the wedge (110) and projecting from the end of the post (14), and a knob (116) rotatable by the user for urging the wedge between the shaft (22) and the inner surface of the post (14) when tightened.

5. The exercycle of claim 1 wherein said pedals (84, 86) are affixed to the seat post (16) by way of a crankshaft (42) journaled in a housing (44) connected to the post (16), said exercycle further comprising:

an adjustable tension control assembly for frictionally engaging said crankshaft (42) with a brake pad (50), said assembly having a pivot plate (48) with a central portion carrying said brake pad (50) and generally conforming to the crankshaft (42), said plate (48) having a lip (52) at one end pivotally engaged with an opening (54) in the seat post (16), and adjustment means (56, 64) coupled to the other end of the plate (48) for pivoting said plate (48) about the lip (52) to control the amount of frictional engagement of the pad (50) against the crankshaft (42).

6. The exercycle of claim 5 wherein said adjustment means comprises:

a threaded shaft (56) projecting through the seat post (16) and into said crankshaft housing (44), and a knob (64) rotatable by user connected to the other end of the threaded shaft (56) whereby the pivot plate (48) is raised or lowered with respect to rotational movement of the knob (64) by the user.

7. The exercycle of claim 1 which further comprises a speedometer display (138) mounted on the handlebar post (14), a sensor (140) for measuring the rotational speed of the rear wheel (88), and a cable (142) threaded through at least the connecting portion (18) of the frame (12) for coupling the sensor (140) to the speedometer display (138).

8. A seat adjustment assembly comprising:

a seat (24), a seat mast (26) with a plurality of pairs of diametrically opposed aligned holes (118) along the longitudinal length thereof, a tubular post (16) having an inboard opening (120) in the form of a hole and a diametrically opposed groove (122) on one end thereof, and a pin (128) for insertion into the mast holes (118) and post hole opening (120) while nesting in the groove (122) whereby the seat (24) may be easily adjusted in height by placing the pin (128) through the desired mast holes (118), nesting the pin (128) in the post groove (122), and inserting the pin (128) through the inboard hole opening (120) in the post (16) which is automatically aligned with the pin (128) when nested in the groove (122) to thereby lock the seat (24) in place.

9. The assembly of claim 8 wherein said groove (122) is V-shaped and the periphery of the inboard hole opening (120) is tangential to the inclined surfaces (124, 126) of the groove (122) such that the pin (128) is wedged in the groove (122) to prevent rotational movement of the seat (24).

10. The assembly of claim 8 wherein said seat mast (26) is tubular with walls of a given thickness, and which further comprises:

retractable means (132) projecting from the periphery of the pin (128) and spaced a given distance from the end thereof, said given distance being less than the thickness of the seat mast walls, operative to initially provide a stop to prevent the end of the pin from protruding beyond the seat mast (26) until the pin is nested in the groove (122) and aligned with said opening (120).

11. The assembly of claim 10 wherein said retractable means comprises a spring loaded ball.

12. In a seat adjustment assembly for an exercycle (10) having a seat (24) connected to a mast (26) which is received by a tubular post (16), the improvement comprising:

means defining a plurality of pairs of diametrically opposed aligned holes (118) along the longitudinal length of the mast (26); means defining an inboard opening (120) in the form of a hole near an end of the post (16); a generally V-shaped groove (122) in the end of the post (16) diametrically opposite said opening (120) and having inclined surfaces (124, 126) which are substantially tangential to the periphery of said opening (120); and a pin (128) adapted to pass through a selected pair of mast holes (118) into the post opening (120) while nesting in said groove (122) to thereby lock the seat (24) in position.

13. An adjustable tension control assembly for an exercycle (10), said assembly comprising:

a seat post (16), a pedal crankshaft (42) journaled in a housing (44) affixed to and rearwardly of said post (16), a pivot plate (48) having a central portion generally conforming to the crankshaft (42), said central portion of said pivot plate (48) engaging said crankshaft (42) through an opening (46) in said housing (44), said plate (48) having a lip (52) at one end pivotally engaged with and passing through an opening (54) in the seat post (16) adjacent to the housing (44), and adjustment means (56, 64) coupled to said seat post and the other end of the plate (48) for pivoting said plate (48) about the lip (52) to control the amount of frictional engagement of the plate (48) against the crankshaft (42).

14. The assembly of claim 13 which further comprises a brake pad (50) lining the central portion of said pivot plate (48).

15. The assembly of claim 14 wherein said adjustment means further comprises:

a shaft (56) projecting through the seat post (16) and into said crankshaft housing (44) and connected to said pivot plate (48), and a knob (64) abutting a tube (62) through which the shaft (56) passes, with said knob (64) threaded to the other end of said shaft (56) to thereby raise or lower the pivot plate (48) to adjust the amount of tension of the brake pad (50) on the crankshaft (42) when said knob (64) is respectively rotated in opposite directions.

* * * * *